US008680788B2

(12) United States Patent
Esaki et al.

(10) Patent No.: US 8,680,788 B2
(45) Date of Patent: Mar. 25, 2014

(54) SEMICONDUCTOR LIGHT-EMITING ELEMENT DRIVER CIRCUIT AND LIGHT FIXTURE USING THE SAME

(75) Inventors: Sana Esaki, Osaka (JP); Akinori Hiramatu, Nara (JP)

(73) Assignee: Panasonic Corporation, Osaka (JP)

( * ) Notice: Subject to any disclaimer, the term of this patent is extended or adjusted under 35 U.S.C. 154(b) by 135 days.

(21) Appl. No.: 13/449,856

(22) Filed: Apr. 18, 2012

(65) Prior Publication Data

US 2012/0262082 A1 Oct. 18, 2012

(30) Foreign Application Priority Data

Apr. 18, 2011 (JP) ..... 2011-092474

(51) Int. Cl.
*H05B 37/02* (2006.01)

(52) U.S. Cl.
USPC ..... 315/307; 315/209 R; 315/246

(58) Field of Classification Search
None
See application file for complete search history.

(56) References Cited

U.S. PATENT DOCUMENTS

| | | | | |
|---|---|---|---|---|
| 7,071,762 | B2 | 7/2006 | Xu et al. | |
| 7,295,176 | B2 * | 11/2007 | Yang | 345/82 |
| 8,203,288 | B2 * | 6/2012 | Lee | 315/308 |
| 2004/0251854 | A1 * | 12/2004 | Matsuda et al. | 315/291 |
| 2010/0259177 | A1 * | 10/2010 | Mednik et al. | 315/185 R |
| 2012/0242246 | A1 * | 9/2012 | Naruo | 315/283 |

* cited by examiner

*Primary Examiner* — Jany Richardson
(74) *Attorney, Agent, or Firm* — Waddey Patterson; Mark J. Patterson; Mark A. Pitchford

(57) ABSTRACT

A driver circuit for a semiconductor light-emitting element enables stable dimmed lighting from very low luminance output to rated luminance output by use of a switching power source operating in a discontinuous mode. The driver circuit includes a DC-DC converter, an output sensor, and a feedback controller. The DC-DC converter includes a burst dimming controller for intermittently stopping an ON/OFF operation of a power switch of the DC-DC converter, thereby reducing a current flowing to the semiconductor light-emitting element. The output sensor detects at least one of the current provided to the semiconductor light-emitting element or the voltage of the semiconductor light-emitting element. The feedback controller adjusts an ON time of the power switch during the ON/OFF operation such that a detected value of the output sensor approaches a target value. Near a dimming control lower limit, power is blocked from the feedback controller.

18 Claims, 6 Drawing Sheets

SEMICONDUCTOR LIGHT-EMITING ELEMENT DRIVER CIRCUIT AND LIGHT FIXTURE USING THE SAME

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is hereby incorporated by reference: Japan Patent Application No. 2011-092474, filed Apr. 18, 2011.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to a driver circuit for a semiconductor light-emitting element such as a light-emitting diode (LED) and a light fixture including the driver circuit.

U.S. Pat. No. 7,071,762 discloses an LED light fixture that uses a switching power supply to receive power from a DC power source and supply a DC current to an LED. Dimming of the LED is controlled according to a burst dimming control method to intermittently interrupt high frequency operation of the switching power source based on a low frequency dimming control. U.S. Pat. No. 7,071,762 further discloses that the low frequency dimming control is feedback controlled based on the current flowing to the LED.

According to a technique described in U.S. Pat. No. 7,071,762, on the assumption that the switching power supply is operated in a continuous mode, to prevent magnetic saturation of an inductor of the switching power supply, the controller of the switching power supply restricts the peak value of current flowing to the inductor. In contrast, by adopting a discontinuous mode of operation, the driver circuit can be simplified. In the discontinuous mode of operation, the switching element of the driver circuit is turned on after a period of no current flowing through an inductor of the driver circuit. Moreover, by setting the OFF time of the switching element to be much longer than the ON time of the switching element, dimmed lighting can be stably realized at very low luminance output (U.S. Patent Application Pub. No. 2011/000457). Although dimmed lighting in a low luminance range can be achieved relatively easily in the discontinuous mode, luminance output varies largely during discontinuous operation in medium to high luminance range due to variation in load characteristics caused by heat generated from the semiconductor light-emitting element (e.g., an LED).

BRIEF SUMMARY OF THE INVENTION

In consideration of such a situation, one object of the present invention is to provide a driver circuit for a semiconductor light-emitting element operable to enable stable dimmed lighting ranging from a very small luminance output to rated luminance output achieved by operating a switching power source operating in the discontinuous mode.

According to a first aspect of the present invention and referring to FIG. 1, a driver circuit for a semiconductor light-emitting element includes a DC-DC converter 3 for converting a DC power source Vdc to supply a DC current to a semiconductor light-emitting element 4, and a dimming controller for controlling the DC-DC converter 3 to adjust the magnitude of the current flowing to the semiconductor light-emitting element 4. The DC-DC converter 3 includes at least a power switch Q1, an inductor L1, and a freewheeling diode D1. The converter 3 operates in a discontinuous mode in which energy from the DC power source Vdc stored in the inductor L1 in an ON period of the power switch Q1 is released through the freewheeling diode D1 in an OFF period of the power switch Q1. The power switch Q1 is turned on after complete release of the energy stored in inductor L1.

The dimming controller includes a burst dimming controller for intermittently stopping an ON/OFF operation of the power switch Q1, thereby adjusting the current flowing to the semiconductor light-emitting element 4. The dimming controller also includes output sensors 5*a* and 5*b* for detecting at least one of the current flowing to the semiconductor light-emitting element 4 or the voltage applied to the semiconductor light-emitting element 4. The dimming controller also includes a feedback circuit 6 for adjusting the ON time of the power switch Q1 during the ON/OFF operation so that a detected value of the output sensors 5*a*, 5*b* approaches a target value.

According to a second aspect of the present invention, in the driver circuit for a semiconductor light-emitting element according to the first aspect of the present invention, the burst dimming controller intermittently stops the ON/OFF operation of the power switch Q1 in one of a range of a dimming control levels.

According to a third aspect of the present invention, in the driver circuit for a semiconductor light-emitting element according to the first aspect of the present invention, the burst dimming controller intermittently stops the ON/OFF operation of the power switch Q1 when the dimming control level is lower than a predetermined value.

According to a fourth aspect of the present invention, in the driver circuit for a semiconductor light-emitting element according to any one of the first to third aspects of the present invention, power to the feedback circuit is blocked when the dimming control level is lower than a predetermined value.

According to a fifth aspect of the present invention, as shown in FIG. 5, a driver circuit for a semiconductor light-emitting element includes a DC-DC converter 3 for converting a DC power source Vdc to supply a DC current to a semiconductor light-emitting element 4. The driver circuit further includes a dimming controller for controlling the DC-DC converter 3 to adjust a magnitude of the current flowing to the semiconductor light-emitting element 4. The DC-DC converter 3 includes at least a power switch Q1, an inductor L1, and a freewheeling diode D1, and operates in a discontinuous mode in which energy stored from the DC power source Vdc in the inductor L1 during an ON time of the power switch Q1 is released through the freewheeling diode D1 during an OFF time of the power switch Q1. The power switch Q1 is turned on after the complete release of stored energy from the inductor L1. The dimming controller includes a burst dimming controller (transistor Tr2) for intermittently stopping an ON/OFF operation of the power switch Q1, thereby adjusting (i.e., reducing) the current flowing to the semiconductor light-emitting element 4. The dimming controller also includes an output sensor 5 for detecting at least one of the current flowing to the semiconductor light-emitting element 4 or the voltage applied to the semiconductor light-emitting element 4, and a feedback circuit including error amplifier EA1 for adjusting a time during which the ON/OFF operation of the power switch Q1 is intermittently stopped so that a detected value of the output sensor 5 approaches a target value.

According to a sixth aspect of the present invention, the burst dimming controller varies the ON time of an ON/OFF cycle of the power switch Q1 according to a DC voltage obtained by smoothing a signal intermittently stopping the ON/OFF operation of the power switch Q1 (see FIG. 3B and FIG. 5).

According to a seventh aspect of the present invention, a bypass circuit including diode D2 and resister R6 is connected in parallel to the semiconductor light-emitting element 4 in parallel. The bypass circuit passes a bypass current larger than the current flowing to the semiconductor light-emitting element 4 in the range of a dimming control lower limit. The output sensor 5*b* detects the current flowing to the semiconductor light-emitting element 4 as a load current which includes the bypass current.

An eighth aspect of the present invention is a light fixture including the driver circuit for a semiconductor light-emitting element according to any one of the first to seventh aspects of the present invention.

According to the present invention, by providing a burst dimming controller for intermittently stopping an ON/OFF operation of a power switch, thereby adjusting current flowing to a semiconductor light-emitting element, dimmed lighting can be achieved in a wide range via a switching power supply operating in a discontinuous mode. Moreover, dimmed lighting ranging from very low luminance output to rated luminance output can be stably achieved by providing an output sensor for detecting at least one of the current flowing to the semiconductor light-emitting element or the voltage applied to the semiconductor light-emitting element, and a feedback circuit for adjusting an ON time of the power switch during the ON/OFF operation or a time during which the ON/OFF operation of the power switch is intermittently stopped so that the detected value approaches the target value.

DETAILED DESCRIPTION OF THE INVENTION

Figure 1:
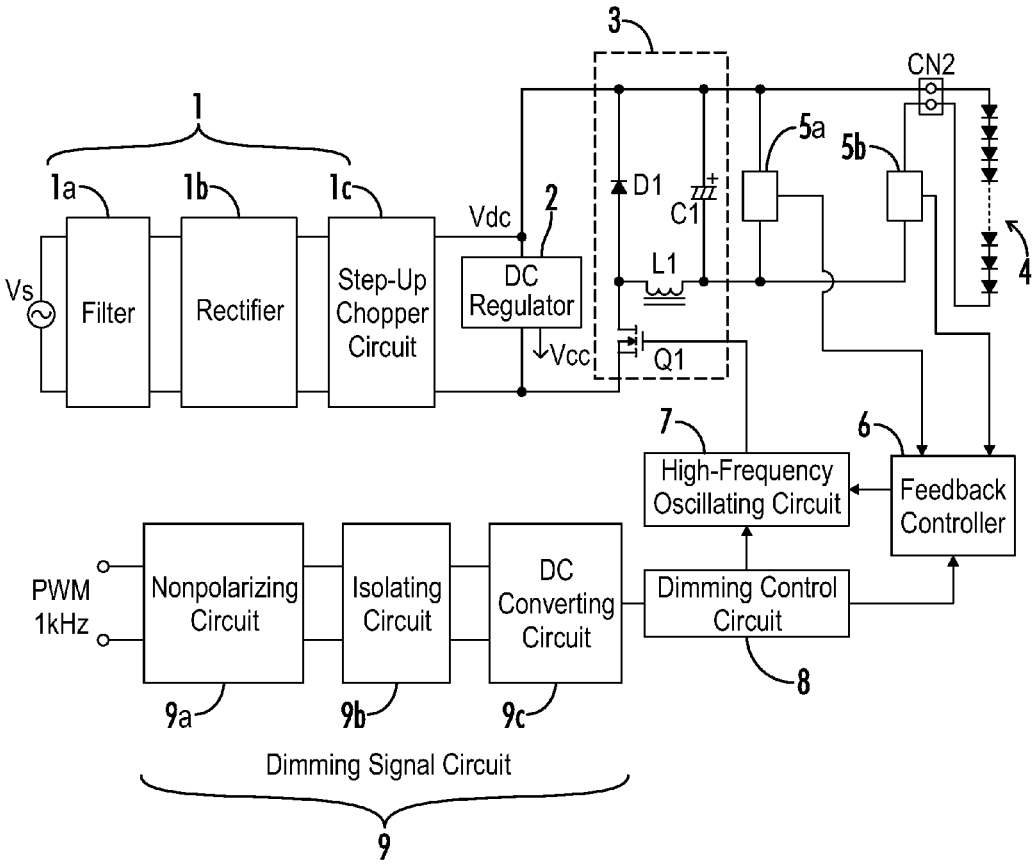
FIG. 1 is a block diagram and partial circuit diagram of a first embodiment of the present invention.

FIG. 1 is a block diagram and partial circuit diagram showing a first embodiment of the present invention. A DC power source 1 includes a filter 1*a*, a rectifier 1*b* and a step-up chopper circuit 1*c*. The DC power source 1 rectifies and smoothes a commercial AC power source voltage Vs and outputs a substantially constant DC power source voltage Vdc. A DC regulator 2 is formed of, for example, a step-down chopper circuit using an IPD controller (see FIG. 4 and the corresponding description below) that lowers the DC power source voltage Vdc and generates a bias voltage Vcc.

The DC-DC converter 3 may be a step-down chopper circuit (buck converter) including a power switch Q1, an inductor L1, a freewheeling diode D1 and a smoothing capacitor C1. The power switch Q1 is turned ON/OFF at a high frequency, thereby converting the DC power source voltage Vdc to a DC output voltage.

The configuration of a step-down chopper circuit is known in the art. A series circuit formed of the smoothing capacitor C1, the inductor L1 and the power switch Q1 is connected between an output of the DC power source 1 and ground. The freewheeling diode D1 is connected in parallel across the series-connected smoothing capacitor C1 and inductor L1.

Standard operation of the step-down chopper circuit is known in the art. When the power switch Q1 is turned on, an increasing current flows from the input DC power source 1, through the smoothing capacitor C1, the inductor L1, and the power switch Q1, and the inductor L1 stores energy. When the power switch Q1 is turned off, current flows from the inductor L1 through the freewheeling diode D1, and the smoothing capacitor C1, releasing the energy stored in the inductor L1.

Turning on the power switch Q1 before the complete release of the energy stored in the inductor L1 is referred to as a continuous mode of operation. Turning on the power switch Q1 upon the complete release of the energy stored in the inductor L1 is referred to as a critical mode of operation. Turning on the power switch Q1 after the complete release of the energy stored in the inductor L1 and a suspension period is referred to as a discontinuous mode. According to one aspect of the present invention, the discontinuous mode is used.

The output of the DC-DC converter 3 is supplied to the semiconductor light-emitting element 4 via a connector CN2. The semiconductor light-emitting element 4 is, for example, a plurality of series circuit connected LEDs. The voltage sensor 5*a* detects the load voltage of the semiconductor light-emitting element 4. A current sensor 5*b* detects the load current of the semiconductor light-emitting element 4. Detection signals from each of the voltage and current sensors 5*a*, 5*b* is passed to a feedback controller 6 and is used to control the power switch Q1. One or both of the voltage and current sensors 5*a*, 5*b* may be used in various embodiments.

The power switch Q1 is cycled ON/OFF at a high frequency by an output of a high-frequency oscillating circuit 7. The ratio of the ON time to OFF time of the power switch Q1 is set by the high-frequency oscillating circuit 7 so that the DC-DC converter 3 operates in the discontinuous mode of operation. In the discontinuous mode of operation, energy stored in the inductor L1 from the DC power source 1 during the ON time of the power switch Q1 is released through the freewheeling diode D1 during the OFF time of the power switch Q1 in each cycle of the power switch Q1. The power switch Q1 is turned on after the complete release of energy stored in the inductor L1. In the discontinuous mode, a stable, very low luminance output can be provided by setting the ratio of the ON time to the OFF time of the power switch Q1 to be extremely small in low luminance lighting.

However, when operating in medium to high luminance range, voltage and current characteristics of the semiconductor light-emitting element 4 vary due to temperature rise caused by heat generated in the semiconductor light-emitting element 4. Due to these changes, the optical output becomes unstable unless feedback control is performed. In contrast, when operating in the low luminance range, variation in the voltage current characteristics of the semiconductor light-emitting element 4 due to temperature rise is limited because the temperature rise is limited.

Thus, in the present embodiment, when the semiconductor light-emitting element 4 produces a large amount of heat operating in the medium to high luminance range, the feedback controller 6 is enabled. The feedback controller 6 adjusts the ON time width of the power switch Q1 that is generated by the high-frequency oscillating circuit 7. In the low luminance range, the ratio (ON time/OFF time) can be set to be extremely small and therefore dimmed lighting with a very minute luminance output can be achieved by stopping the operation of the feedback controller 6 and intermittently stopping the high-frequency ON/OFF operation of the power switch Q1 via a dimming control circuit 8.

The dimming control circuit 8 controls the ON time width of the power switch Q1 generated by the high-frequency oscillating circuit 7 so that, in the medium to medium high luminance range, the detection signal of each of the sensors 5*a*, 5*b* converges to a target value. The target value is determined by a dimming control voltage from a dimming signal circuit 9. In the low luminance range, the ON time width of the power switch Q1 generated by the high-frequency oscillating circuit 7 is fixed or can be varied according to the dimming control voltage from the dimming signal circuit 9. The ratio of intermittent stopping of the high-frequency ON/OFF operation of the power switch Q1 is varied according to the dimming control voltage from the dimming signal circuit 9.

The dimming signal circuit 9 includes a non-polarizing circuit 9*a*, an isolating circuit 9*b*, and a DC converting circuit 9*c*. The dimming signal circuit 9 receives an external dimming control signal via a dimming control signal line and outputs a dimming control voltage as a function of the received dimming control signal. The external dimming control signal is, for example, a PWM signal having an amplitude of 10V and a frequency of about 1 kHz. The non-polarizing circuit 9*a* includes, for example, a full-wave rectifier that rectifies the dimming control signal and references the dimming control signal to circuit ground. The isolating circuit 9*b* includes, for example, a photo-coupler that isolates the dimming control signal line from the driver circuit. The DC converting circuit 9*c* includes, for example, a smoothing circuit or filter that outputs a DC voltage having a level corresponding to a pulse width of the PWM signal (i.e., the dimming control signal), as the dimming control voltage.

Figure 2:
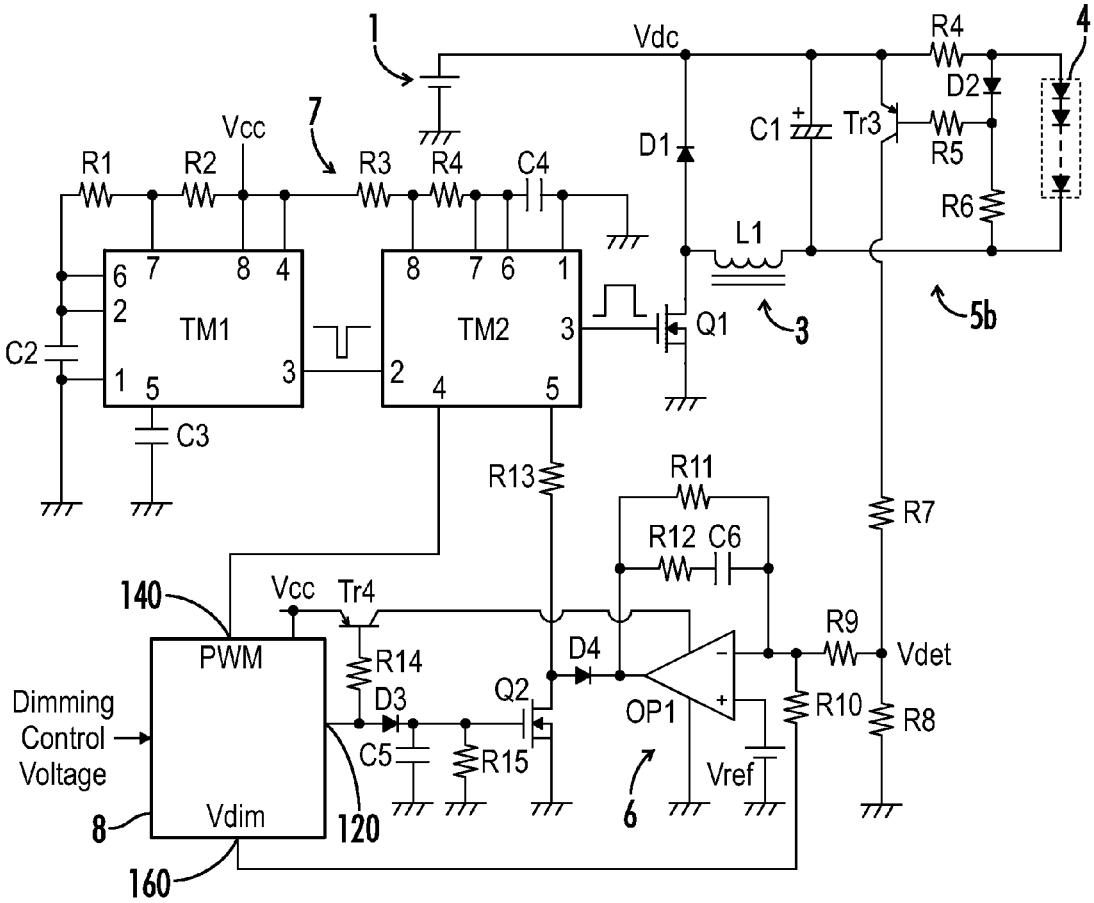
FIG. 2 is a circuit diagram of a second embodiment of the present invention.

One embodiment further implementing the basic configuration shown in FIG. 1 will be described with reference to FIG. 2. In the embodiment of FIG. 2, the configuration of the current sensor 5*b*, the feedback controller 6, and the high-frequency oscillating circuit 7 in FIG. 1 is further illustrated.

The high-frequency oscillating circuit 7 is configured of general timer circuits TM1, TM2 and their peripheral circuits. The first timer circuit TM1 is an astable multivibrator for setting the ON/OFF frequency of the power switch Q1. The second timer circuit TM2 is a monostable multivibrator for setting an ON pulse width of the power switch Q1.

Figure 3A:
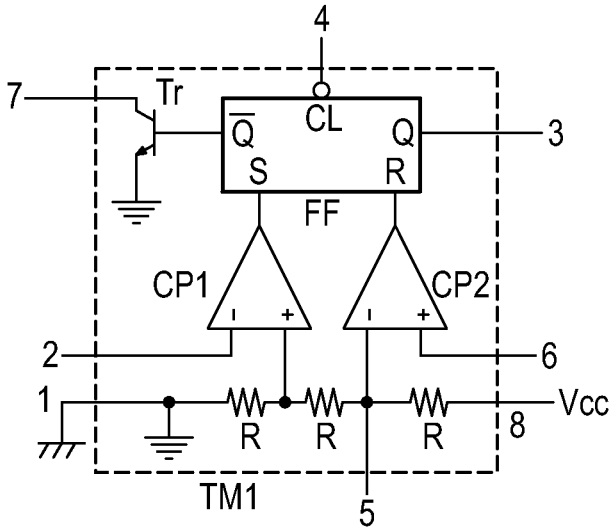
FIGS. 3A and 3B are circuit diagrams of a first timer circuit TM1 and components attached to the first timer circuit TM1 according to a third embodiment of the present invention.

The timer circuits TM1, TM2 each are a conventional timer IC having an internal configuration shown in FIG. 3A (i.e., a 555 timer), and is, for example, a μPD5555 manufactured by Renesas Electronics Corporation (a subsidiary of NEC Electronics Corporation). Alternatively, the first and second timer circuits TM1, TM1 may be a dual version 555 timer (μPD5556) or any compatible timer circuit. The first terminal of the timer circuits is a ground terminal and an eighth terminal is a power terminal μPD5555 or μPD5556 timer circuits.

A second terminal is a trigger terminal. When the voltage at the second terminal is less than half of the voltage at a fifth terminal (which is generally one third of the bias voltage Vcc), an internal flip-flop FF is set by an output of a first comparator CP1, a third terminal (output terminal) is set to a High level and a seventh terminal (which is a discharging terminal) is put into an opened state.

A fourth terminal is a reset terminal, and when this terminal is set to a Low level, the timer TM1 is put into an operation stopping state and the third terminal (which is the output terminal) is fixed to a Low level.

The fifth terminal is a control terminal and a reference voltage of two thirds of the bias voltage Vcc is generally applied internally to this terminal by an internal breeder resistor (i.e., a series circuit formed of three resistors R).

A sixth terminal is a threshold terminal. When the voltage at the sixth terminal is higher than the voltage at the fifth terminal (which is generally two thirds of the bias voltage Vcc), the internal flip-flop FF is reset by an output of a second comparator CP2, the third terminal (i.e., the output terminal) is set to a Low level and the seventh terminal (i.e., the discharging terminal) is short-circuited to the first terminal by an internal transistor Tr.

The first timer circuit TM1 operates as an astable multivibrator and has a time constant determined by externally attached resistors R1 and R2 and a capacitor C2. The voltage of the capacitor C2 is inputted to the second terminal (i.e., the trigger terminal) and the sixth terminal (i.e., the threshold terminal) and is compared with the internal reference voltages (which are generally one third or two thirds of the bias voltage Vcc). The voltage of the fifth terminal is stabilized by an external capacitor C3.

At an initial stage of power-on, the voltage of the capacitor C2 at the second terminal (i.e., trigger terminal) is lower than the first reference voltage (i.e., one third of the bias voltage Vcc). Therefore, the third terminal (i.e., the output terminal) goes to a High level and the seventh terminal (i.e., the discharging terminal) is set to the opened state. The capacitor C2 is thus charged from the bias voltage Vcc via the resistors R2, R1.

When the voltage of the capacitor C2 at the sixth terminal (i.e., the threshold terminal) is higher than the second reference voltage (i.e., two thirds of the bias voltage Vcc), the third terminal (i.e., the output terminal) goes to a Low level and the seventh terminal (i.e., the discharging terminal) is short-circuited to the first terminal. Thereby, the capacitor C2 is discharged via the resistor R1.

When the voltage of the capacitor C2 at the second terminal (i.e., trigger terminal) is lower than the first reference voltage (i.e., one third of the bias voltage Vcc), the third terminal (i.e., the output terminal) goes to a High level and the seventh terminal (i.e., the discharging terminal) is put into the opened state. Thereby, the capacitor C2 is charged from the bias voltage Vcc via the resistors R2, R1 again. Thereafter, the same operation is repeated.

The time constant is set by the resistors R1, R2 and the capacitor C2 such that an oscillating frequency of the third terminal (i.e., the output terminal) is a relatively high frequency in the range of a few dozen kilohertz. Resistance values of the resistors R1 and R2 are selected such that the resistance value of resistor R1 is much smaller than the resistance value of resistor R2. For this reason, the capacitor C2 is discharged via the resistor R1 (while the output terminal of the third terminal is at a Low level) much quicker than the capacitor C2 is charged via the resistors R2 and R1 (while the output terminal of the third terminal is at a High level). Thus, a pulse of Low level having a relatively short pulse width is repeatedly outputted from the third terminal (i.e., the output terminal) of the first timer circuit TM1 at a relatively high frequency in the range of a few dozens of kilohertz. Using the falling edge of this short width pulse, the second terminal of the second timer circuit TM2 is triggered once each cycle.

The second timer circuit TM2 has a time constant set by a resistor R3 and a capacitor C4 externally attached thereto. The second timer circuit TM2 operates as a monostable multivibrator. When the falling edge of a Low level pulse having a relatively short pulse width is received at a second terminal (i.e., a trigger terminal) of the second timer circuit TM2, a third terminal (i.e., an output terminal) of the second timer circuit TM2 goes to a High level and a seventh terminal (i.e., a discharging terminal) of the second timer circuit TM2 is put into an opened state. The capacitor C4 is thus charged via resistor R3 which is a time constant setting resistor R3 of the second timer circuit TM2. When a second comparator CP2 of the second timer circuit TM2 determines that the charging voltage (i.e., the voltage at the sixth terminal or threshold terminal) is higher than the reference voltage (i.e., the voltage at the fifth terminal of the second timer circuit TM2), the third terminal (i.e., the output terminal) of the second timer circuit TM2 is set to a Low level and a seventh terminal (i.e., the discharging terminal) is short-circuited to the first pin. The capacitor C4 is thereby instantaneously discharged.

The time required to charge the capacitor C4 from ground voltage to the reference voltage (i.e., the voltage at the fifth terminal) determines the pulse width of a pulse signal of a High level output from the third terminal of the second timer circuit TM2. The maximum value of the time required to charge the capacitor C4 to the reference voltage is selected to be shorter than a period (i.e., the time of one cycle) of the first timer circuit TM1. A minimum value of the time required to charge the capacitor C4 to the reference voltage is selected to be longer than the pulse width of a trigger pulse of a Low level output from the third terminal of the first timer circuit TM1.

The pulse signal output from the third terminal of the second timer circuit TM2 is a drive signal of the power switch Q1. The ON time of the pulse (i.e., the pulse width) is controlled by the voltage at the fifth terminal of the second timer circuit TM2 and becomes smaller as the voltage at the fifth terminal is reduced.

One embodiment of the feedback controller 6 for controlling the voltage at the fifth terminal of the second timer circuit TM2 will be described with reference to FIG. 2. The feedback controller 6 includes an operational amplifier OP1 and its peripheral circuits. A feedback impedance formed of resistors R11, R12 and a capacitor C6 is connected between an inverting input terminal and an output terminal of the operational amplifier OP1. A reference voltage Vref is applied to a non-inverting input terminal of the operational amplifier OP1. The voltage of the output terminal of the operational amplifier OP1 varies so that the voltage of the inverting input terminal of the operational amplifier OP1 corresponds to the voltage of the non-inverting input terminal (i.e., reference voltage Vref). The detection voltage Vdet of the current sensor 5*b* is inputted to the inverting input terminal of the operational amplifier OP1 via a first input resistor R9. A dimming control voltage Vdim is inputted from the dimming control circuit 8 to the inverting input terminal of the operational amplifier OP1 via a second input resistor R10.

When the dimming control voltage Vdim increases, the output voltage of the operational amplifier OP1 decreases, increasing current drawn from the fifth terminal of the second timing circuit TM2 via resistor R13 and diode D4. The reference voltage at the fifth terminal of the second timing circuit TM2 decreases. As a result, the ON time width of the power switch Q1 decreases. In contrast, when the dimming control voltage Vdim decreases, the output voltage of the operational amplifier OP1 rises and the current drawn from the fifth terminal of the second timing circuit TM2 via the resistor R13 and the diode D4 decreases, such that the reference voltage at the fifth terminal rises. As a result, the ON time width of the power switch Q1 increases.

Also, if the dimming control voltage Vdim is held constant while the detection voltage Vdet varies, as the detection voltage Vdet increases, the ON time width of the power switch Q1 decreases. Conversely, when the detection voltage Vdet decreases, the ON time width of the power switch Q1 increases. That is, feedback control is achieved so as to suppress variation in the output. In this manner, the ON time width of the power switch Q1 is controlled so that the detection voltage Vdet corresponds to a magnitude of the dimming control voltage Vdim.

The above-mentioned operation is made in the medium to high luminance range. In the low luminance range (for example, a low luminous flux range less than 10% of full lighting), feedback control by the operational amplifier OP1 is stopped and the ON time width of the power switch Q1 is fixed to a minimum value. Instead of varying the ON time of the pulse width, the high frequency ON/OFF operation of the power switch Q1 is intermittently stopped to achieve further dimming control.

While operating in the low luminance range, the output terminal 120 of the dimming control circuit 8 is set to a High level. When the output terminal 120 of the dimming control circuit 8 is set to a High level, an ON driving signal is inputted to a control electrode of a switching element Q2 via a diode D3, so that the switching element Q2 is put into an ON state. The reference voltage at the fifth terminal of the second timer circuit TM2 is thus fixed to a minimum value determined by the voltage division ratio of the internal breeder resistor and the resistor R13. The ON time width of the power switch Q1 is also fixed to a minimum value in a range that can be controlled by the operational amplifier OP1. When the output terminal 120 of the dimming control circuit 8 is set to a High level (e.g., the voltage of the bias voltage Vcc), the base current of a transistor Tr4 is blocked via a resistor R14. The transistor Tr4 is thus turned off such that no bias voltage Vcc is supplied to the operational amplifier OP1. Therefore, excessive power consumption of the operational amplifier OP1 in the low luminance range is prevented.

It is preferred that the output voltage of the operational amplifier OP1 is at the minimum value when the output terminal 120 of the dimming control circuit 8 is switched to a High level. That is, an anode potential of the diode D4 hardly varies before and after turning-on of the switching element Q2.

The output terminal 120 of the dimming control circuit 8 is switched to a Low level to switch from the low luminance range back to the medium luminance range and to restart the operation of the operational amplifier OP1. The base current thus flows to transistor Tr4 via resistor R14, and the transistor Tr4 is put into an ON state, supplying the bias voltage Vcc to the operational amplifier OP1. Further, because the ON driving signal supplied via the diode D3 is blocked, the switching element Q2 is turned off. It should be noted, however, that the switching element Q2 remains in an ON state temporarily until the operation of the operational amplifier OP1 stabilizes.

A timer circuit formed of a capacitor C5 and a resistor R15 is connected to the control electrode of the switching element Q2 to temporarily maintain the switching element Q2 in the ON state. The time constant set by the capacitor C5 and the resistor R15 is set to approximately the time required for operation of the operational amplifier OP1 to stabilize. Thus, as the voltage of the capacitor C5 lowers, the switching element Q2 gradually shifts to an OFF state. When the switching element Q2 is completely turned off, the operation of the operational amplifier OP1 has stabilized and current is drawn via the resistor R13 to the output terminal of the operational amplifier OP1 via the diode D4. Thus, the ON time width of the power switch Q1 is controlled by the operational amplifier OP1.

By providing some hysteresis so that the dimming control voltage Vdim1 at a time when the output terminal 120 of the dimming control circuit 8 shifts from a Low level to a High level is larger than a dimming control voltage Vdim2 at a time when the output terminal 120 of the dimming control circuit 8 shifts from a High level to a Low level, frequent switching between operation in the low luminance range and medium luminance range can be avoided.

Control in the low luminance range may now be described. When shifting to control in the low luminance range, the dimming control circuit 8 fixes the switching element Q2 to its ON state and the ON time width of the power switch Q1 is fixed to the minimum value. To further dimming control, the OFF time of the power switch Q1 is extended.

Thus, by outputting a low frequency PWM signal from a PWM terminal 140 of the dimming control circuit 8 to the fourth terminal of the second timer circuit TM2, the high frequency ON/OFF operation of the power switch Q1 is intermittently stopped when the PWM signal is at a Low level. In the medium to high luminance range, the PWM terminal 140 is fixed to a High level and the second timer circuit TM2 is operable at all times (i.e., is not intermittently stopped). In contrast, in the low luminance range, the PWM terminal 140 is switched between High and Low at a low frequency, and the ratio of the time at Low level is increases as dimming becomes deeper (i.e., luminance is reduced). That is, by increasing the OFF time of the power switch Q1 according to burst dimming control while keeping the minimum value of the ON time width of the power switch Q1, the ratio (ON time/OFF time) can be controlled to an extremely small value and therefore, dimmed lighting can be achieved at very low luminance output.

It is known that, in such a case where dimmed lighting is achieved at very small luminance output, it is preferred that a bypass circuit for passing a bypass current larger than a lighting current of the semiconductor light-emitting element 4 is provided in parallel with the semiconductor light-emitting element 4. Thus, in the present embodiment, the detection range of the current sensor 5*b* is extended by efficiently utilizing such a bypass circuit.

In the current sensor 5*b* shown in FIG. 2, a series circuit formed of a diode D2 and a resistor R6 is connected in parallel with the semiconductor light-emitting element 4. The resistor R6 may be replaced with a constant current circuit. Preferably, diode D2 has similar temperature characteristics as the diode between the base and emitter of a transistor Tr3 of the current sensor 5*b*. Because the forward voltage of the diode D2 and the voltage between the base and emitter of the transistor Tr3 substantially offset each other, the voltage between across current detecting resistor R4 can be copied as the voltage between across base bias resistor R5 of the current sensor 5*b*. Although the current detecting resistor R4 has a low resistance and the base bias resistor R5 has a high resistance, current flowing to the base bias resistor R5 is obtained by dividing the voltage across resistor R5. Therefore, the base current corresponding to the current flowing through the current detecting resistor R4 (the sum of lighting current and bypass current) can be passed to the transistor Tr3. The detection voltage Vdet corresponding to the voltage between both ends of a current detecting resistor R4 can be obtained between both ends of the resistor R8 because a collector current corresponding to the base current flows to a series circuit formed of resistors R7, R8.

If the bypass circuit formed of the series circuit formed of the diode D2 and the resistor R6 did not exist, the voltage across the current detecting resistor R4 would decrease as the lighting current decreased. Thus, the diode between the base and emitter of the transistor Tr3 would not be turned on, making current detection difficult. In the present embodiment, by flowing the bypass current to the current detecting resistor R4 at all times, the voltage between across the current detecting resistor R4 can be increased even when the lighting current is small. Moreover, because the diode between the base and emitter of the transistor Tr3 can be turned on by a forward voltage of diode D2, even when the load current is small, the lighting current can be detected.

Although the current detecting resistor R4 should detect only the lighting current flowing to the semiconductor light-emitting element 4, in the present embodiment, the current detecting resistor R4 also detects a current increased by the bypass current (i.e., the current flowing to the series circuit formed of the diode D2 and the resistor R6) in addition to the lighting current flowing to the semiconductor light-emitting element 4. Because the load voltage of the semiconductor light-emitting element 4 is relatively stable, the variance range of the bypass current is smaller than that of the lighting current. Moreover, because the effect of the bypass current can be easily removed, for example, by replacing the resistor R6 with a constant current circuit, the lighting current can be detected in practice.

In the present embodiment, as described above, feedback control in the low luminance range (for example, a low luminous flux less than 10% of full lighting) is omitted. Feedback control is performed in the medium to high luminance range, in which the lighting current is larger than the bypass current. Accordingly, the detection voltage Vdet mainly reflects the lighting current and increase of the bypass current can be ignored.

The dimming control circuit 8 in FIG. 2 may be configured by a microprocessor or application specific integrated circuit (ASIC). For example, the analog dimming control voltage outputted from the dimming signal circuit 9 in FIG. 1 is read by an A/D converter of the dimming control circuit at an A/D conversion input port. The dimming control voltage Vdim is determined by looking up the output of the A/D converter in an internal memory table. The determined dimming control voltage Vdim is outputted from a D/A conversion output terminal 160. To perform feedback control based on the dimming control voltage Vdim in the medium to high luminance range, the output terminal 120 is set to a Low level and the PWM terminal 140 is fixed to a High level. To stop feedback control in the low luminance range, the output terminal 120 is set to a High level, and to intermittently stop the high frequency ON/OFF operation at a low frequency, the PWM terminal 140 is switched to High/Low at the low frequency. The ratio of Low level time to High level time may be determined referring to an internal memory table based on the value of the analog dimming control voltage received at the A/D conversion input port from the dimming signal circuit 9 in FIG. 1.

Figure 3B:
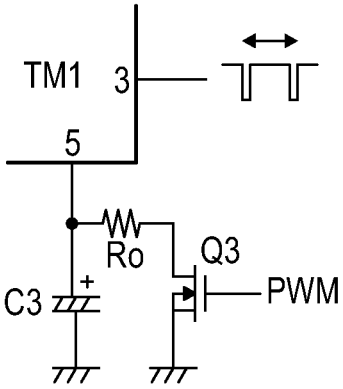

FIG. 3B shows a configuration of a circuit adjacent the first timer TM1 according to another embodiment of the present invention. In this embodiment, by making the voltage at the fifth terminal of the first timer circuit TM1 variable in a low luminance range, the frequency of high frequency ON/OFF operation of the power switch Q1 is made variable.

As described above, to perform dimmed lighting at low luminance output, it is advantageous that the frequency of the high frequency ON/OFF operation of the power switch Q1 decreases as it approaches a dimming control lower limit.

In the embodiment shown in FIG. 2, because the voltage at the fifth terminal of the first timer circuit TM1 is fixed, the frequency of the high frequency ON/OFF operation of the power switch Q1 is fixed. In contrast, in the modified example shown in FIG. 3B, a series circuit including a resistor Ro and a switching element Q3 is connected in parallel to a capacitor C3. The capacitor C3 is connected to the fifth terminal of the first timer circuit TM1, such that the switching element Q3 can be turned ON/OFF according to a low frequency PWM signal. The signal outputted from the PWM terminal 140 of the dimming control circuit 8 in FIG. 2 may be used as the low frequency PWM signal.

In a state where the PWM terminal 140 of the dimming control circuit 8 in FIG. 2 is set at a High level and not switching (e.g., the medium to high luminance range operation), the switching element Q3 is in an ON state at all times. The voltage at the fifth terminal of the first timer circuit TM1 is determined based on the voltage division ratio of an internal bleeder resistor (refer to FIG. 3A) and the external resistor Ro and is lower than two-thirds of the bias voltage Vcc. Thus, the oscillating frequency of the first timer circuit TM1 is greater than when the voltage at the fifth terminal is two thirds of the bias voltage Vcc.

In a state where the PWM terminal 140 of the dimming control circuit 8 in FIG. 2 is switched between High and Low at a low frequency (i.e., low luminance range operation), the switching element Q3 is intermittently turned off. As the OFF time of the switching element Q3 increases (i.e., the period during which the power switch Q1 oscillates at a high frequency increases), the voltage at the fifth terminal of the first timer circuit TM1 rises toward two thirds of the bias voltage Vcc. Therefore, the high frequency oscillating frequency of the first timer circuit TM1 decreases. Thus, because the number of times the power switch Q1 is turned on decreases, dimmed lighting can be achieved at a very low luminance output.

Figure 4:
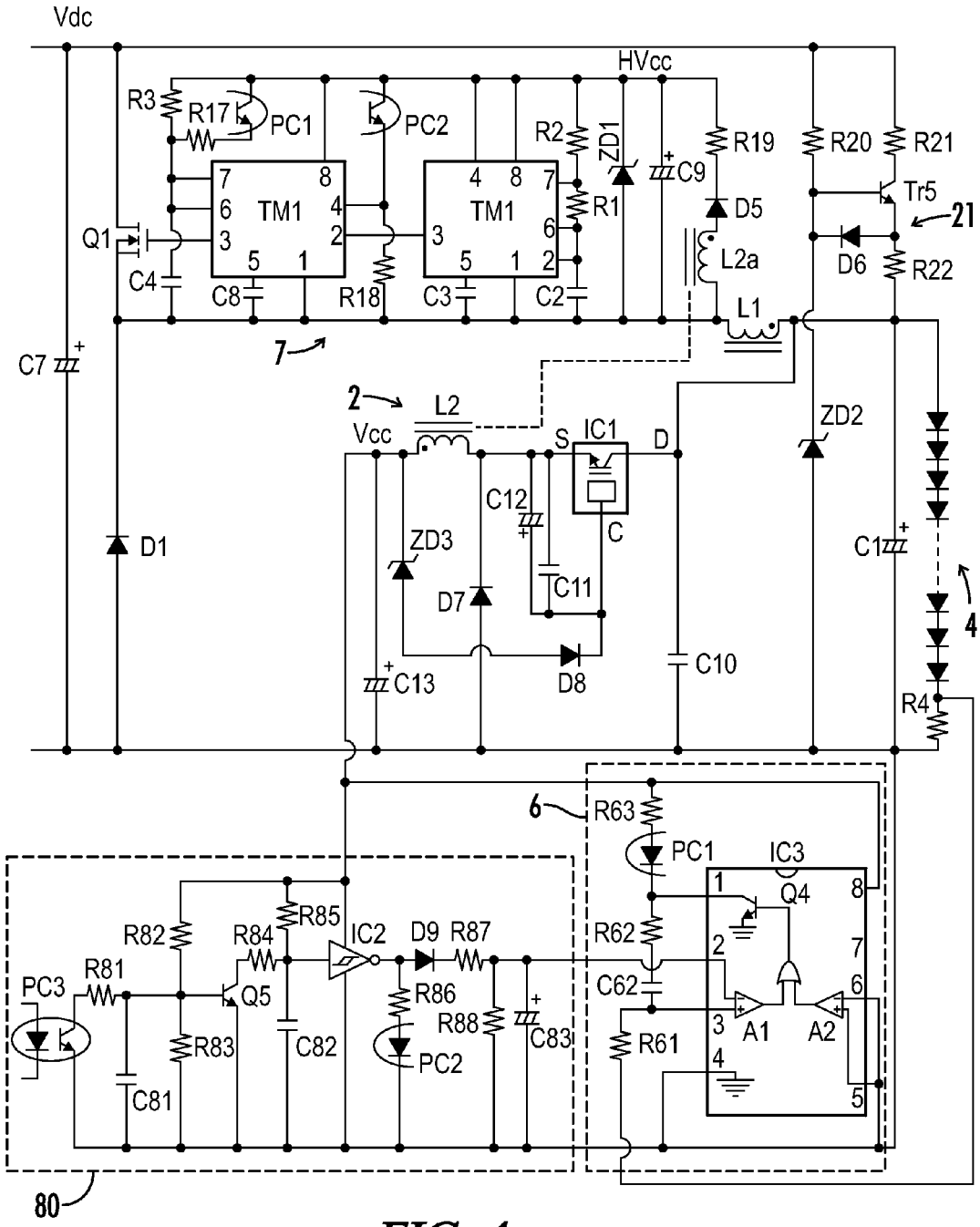
FIG. 4 is a circuit diagram of a fourth embodiment of the present invention.

FIG. 4 is a circuit diagram of another embodiment of the present invention. In this embodiment, the power switch Q1 of a step-down chopper circuit is arranged on a high potential side and the semiconductor light-emitting element 4 is arranged on a low potential side. Because the semiconductor light-emitting element 4 is arranged on the low potential side, the lighting current flowing to the semiconductor light-emitting element 4 can be detected more easily as compared to other embodiments. The feedback controller 6 is arranged on the low potential side, so that a control target signal acquired from a dimming control circuit 80 can be directly compared with a detection signal acquired from the current detecting resistor R4.

In contrast, in another embodiment, because the power switch Q1 is arranged on a high potential side, any driving circuit needs to be arranged on the high potential side. In the present embodiment, the high-frequency oscillating circuit 7 formed of the timer circuits TM1 and TM2 is arranged on the high potential side. Although the configuration of the high-frequency oscillating circuit 7 in the present embodiment is basically the same as the high-frequency oscillating circuit 7 in the second embodiment in FIG. 2, photo-couplers PC1, PC2 are added to the timer circuit TM2 in a second stage in the present embodiment.

In the timer circuit TM2 in FIG. 2, a reference voltage at the fifth terminal is variably controlled and the time constant setting resistor R3 is set to a fixed value. In contrast, for the timer circuit TM2 in FIG. 4, the reference voltage at the fifth terminal is set to a fixed value stabilized by a capacitor C8. A series circuit formed of a resistor R17 and a light receiving element of the photo-coupler PC1 is connected in parallel with the time constant setting resistor R3. The current of a light emitting element of the photo-coupler PC1 is controlled by the feedback controller 6. When the resistance value of the light receiving element of the photo-coupler PC1 decreases, the charging rate of the capacitor C4 rises, such that an ON time width of the power switch Q1 is decreased.

The light receiving element of the photo-coupler PC2 that can be turned on/off at low frequency is inserted between the eight terminal and the fourth terminal of the timer circuit TM2, and the fourth terminal is pulled down to a potential of the first terminal by resistor R18. The light emitting element of the photo-coupler PC2 can be switched between conduction/blocking at a low frequency by the dimming control circuit 80. When current flows to the light emitting element of the photo-coupler PC2, the light receiving element of the photo-coupler PC2 is turned on. When the current flowing to the light emitting element of the photo-coupler PC2 is blocked, the light receiving element of the photo-coupler PC2 is turned off.

When the light receiving element of the photo-coupler PC2 is turned off, the fourth terminal of the timer circuit TM2 is pulled down by the resistor R18 to a Low level, and the voltage at the output terminal (third terminal) is fixed to a Low level. When the light receiving element of the photo-coupler PC2 is turned on, the fourth terminal of the timer circuit TM2 is set to a High level, and the timer circuit TM2 begins operating as a monostable multivibrator.

When the high-frequency oscillating circuit 7 is arranged on the high potential side as in the present embodiment, as distinct from the case where the high-frequency oscillating circuit 7 is arranged on the low potential side, there is no need to transmit a high frequency control signal from the low potential side to the high potential side. That is, because the transmission signal of the photo-coupler PC1 in FIG. 4 is an analog signal relating to control of an ON time width of the power switch Q1 and the transmission signal of the photo-coupler PC2 is a low frequency ON/OFF signal for burst dimming control, both the photo-couplers can use an inexpensive element having a low transmission rate. If the high-frequency oscillating circuit 7 is arranged on the low potential side, the driving ability of the timer circuit TM2 in the second stage cannot be directly applied to ON/OFF control of the power switch Q1 on the high potential side. Furthermore, it is desirable to transmit the control signal to a driving circuit separately provided on the high potential side by use of a high-speed photo-coupler. Therefore, as shown in FIG. 4, it is advantageous that the high-frequency oscillating circuit 7 formed of the timer circuits TM1, TM2 is arranged on the high potential side to enable the use of cheap low speed photo-couplers.

Arranging the high-frequency oscillating circuit 7 on the high potential side requires a stable control power voltage HVcc on the high potential side. In the present embodiment, the control power circuit 2 can supply the bias voltage Vcc and the stable control power voltage HVcc to the low potential side and the high potential side irrespective of the dimmed lighting state. The control power circuit 2 is connected in parallel with the semiconductor light-emitting element 4. Although the control power circuit 2 needs to flow a minimum consumption current at all times to generate the bias voltage Vcc and stable control power voltage HVcc, dimmed lighting of the semiconductor light-emitting element 4 is stabilized by effectively using the minimum consumption current as the bypass current.

One configuration of the control power circuit 2 may now be described. The control power circuit 2 includes an IPD controller IC1 and its peripheral circuitry. The control power circuit 2 is connected to the smoothing capacitor C1 to which the semiconductor light-emitting element 4 is connected. The IPD controller IC1 is a so-called intelligent power device such as an MIP2E2D manufactured by Panasonic Corporation. This is a three-pin IC having a drain terminal D, a source terminal S and a control terminal C. It includes a power MOSFET switching element and a control circuit for controlling its ON/OFF operation therein.

The switching element connected between the drain terminal D and the source terminal S of the IPD controller IC1, an inductor L2, a smoothing capacitor C13 and a diode D7 constitute a step-down chopper circuit. A Zener diode ZD3, a diode D8, a smoothing capacitor C12 and a capacitor C11 constitute a power circuit of the IPD controller IC1.

At an initial stage of power-on, the voltage of the smoothing capacitor C1 rises via an activating circuit 21. Current flows in a path of the drain terminal D and the control terminal C of the IPD controller IC1, the smoothing capacitor C12, the inductor L2 and the smoothing capacitor C13. Thus, the smoothing capacitor C12 is charged according to the illustrated polarity. The voltage of the smoothing capacitor C12 becomes an operating voltage for a control circuit in the IPD controller IC1, and the IPD controller IC1 starts switching on/off a switching element between the drain terminal D and the source terminal S.

When the switching element between the drain terminal D and the source terminal S of the IPD controller IC1 is turned on, current flows in a path of the smoothing capacitor C1, the drain terminal D and the source terminal S of the IPD controller IC1, the inductor L2 and the smoothing capacitor C13, thereby charging the smoothing capacitor C13. When the switching element is turned off, energy stored in the inductor L2 is released to the smoothing capacitor C13 via the diode D7. Thereby, the circuit formed of the IPD controller IC1, the inductor L2, the diode D7 and the smoothing capacitor C13 operates as the step-down chopper circuit, and the bias voltage Vcc lowered from the voltage of the smoothing capacitor C1 is obtained at the smoothing capacitor C13.

When the switching element between the drain terminal D and the source terminal S of the IPD controller IC1 is turned off, a regenerative current flows via the diode D7, and the voltage across the inductor L2 is clamped to a sum of the voltage Vc13 of the smoothing capacitor C13 and a forward voltage Vd7 of the diode D7 (i.e., Vl2=Vc13+Vd7). The voltage Vc12 of the capacitor C12 is obtained by subtracting a sum of a Zener voltage Vz3 of the Zener diode ZD3 and a forward voltage Vd8 of the diode D8 (Vz3+Vd8) from the above-mentioned inductor L2 voltage (Vc13+Vd7). The control circuit in the IPD controller IC1 controls turning-on/off of the switching element between the drain terminal D and the source terminal S of the IPD controller IC1 so that the voltage Vc12 of the capacitor C12 connected between the source terminal S and the control terminal C becomes constant. This makes the voltage of the smoothing capacitor C13 constant and at the same time, provides operating power to the IPD controller IC1.

When the smoothing capacitor C13 reaches the bias voltage Vcc, the dimming control circuit 80 and the feedback controller 6 start their operations, and the control power voltage HVcc is supplied to timer circuits IC1, IC2 arranged on the high potential side from a high-side power circuit. The high-side power circuit charges a smoothing capacitor C9 via a diode D5 and a resistor R19 via an output of a secondary winding L2*a* of the inductor L2 of the control power circuit 2 arranged on the low potential side. The charging voltage (i.e., the control power voltage HVcc) is made constant by zener diode ZD1. The first and second timer circuits TM1, TM2 start their operations, thereby turning on/off the power switch Q1 at a high frequency.

The activating circuit 21 of the control power circuit 2 may now be described. When the charging voltage of the smoothing capacitor C1 is low at initial power-on, current flows to the smoothing capacitor C1 via a resistor R20, between the base and emitter of transistor Tr5, and a resistor R22. The transistor Tr5 is thus turned on, and the smoothing capacitor C1 is charged via a resistor R21, between the collector and emitter of the transistor Tr5, and the resistor R22. When the charging voltage of the smoothing capacitor C1 reaches an activating voltage for the IPD controller IC1 of the control power circuit 2, the IPD controller IC1 starts its oscillating operation. The smoothing capacitor C13 acquires the bias voltage Vcc on the low potential side, and the smoothing capacitor C9 acquires the control power voltage HVcc on the high potential side to act as a power source for the timer circuits TM1, TM2. With these power voltages Vcc, HVcc established, the ON/OFF operation of the power switch Q1 starts, and the charging voltage of the smoothing capacitor C1 further rises.

The zener voltage of a zener diode ZD2 is set higher than the activating voltage for the IPD controller IC1 of the control power circuit 2, and lower than a light-emitting voltage for the semiconductor light-emitting element 4 (for example, 80V to 98V). Therefore, when the power switch Q1 starts the ON/OFF operation and the voltage of the smoothing capacitor C1 reaches the light-emitting voltage for the semiconductor light-emitting element 4, current flows in a path of the smoothing capacitor C1, the resistor R22, a diode D6, and the zener diode ZD2 in the reverse direction, reverse-biasing the base and emitter of the transistor Tr5. Therefore, the transistor Tr5 is kept in its OFF state, and activating current of the transistor Tr5 is blocked.

In the circuit in FIG. 4, in a dimming control range of the semiconductor light-emitting element 4 (for example, 50 μA to 300 mA), a sum of a consumption current of the control power circuit 2 and a consumption current via a series circuit formed of the resistor R22 and the diode D6 of the activating circuit 21 and the zener diode ZD2 is set to be equal to or larger than the bypass current (for example, 6 to 7 mA) flowing through the diode D2 and the resistor R6 in the second embodiment. Thus, the bypass current consumed as heat energy in the second embodiment can be effectively used, advantageously reducing power loss.

The feedback controller 6 may now be described. The feedback controller 6 includes a feedback control integrated circuit IC3 (for example, NJM2146B manufactured by New Japan Radio Co., Ltd.) that has operational amplifiers A1, A2 and an output transistor Q4 therein, and associated peripheral circuitry. The detection voltage of the current detecting resistor R4 is inputted to a non-inverting input terminal (third terminal of the integrated circuit IC3) of the operational amplifier A1 via an input resistor R61. A control target voltage outputted from the dimming control circuit 80 is inputted to an inverting input terminal (second terminal). A series circuit formed of resistor R62 and capacitor C62, which is connected between the output terminal (first terminal) and the non-inverting input terminal (third terminal), is a feedback impedance. Although the other operational amplifier A2 is not used in the present embodiment, it may be used for voltage feedback control to stabilize an applied voltage of the semiconductor light-emitting element 4 to a target voltage when dimmed lighting is deep, as needed (see JPA 2009-232623).

The bias voltage Vcc is supplied between a power terminal (eighth terminal) and a ground terminal (fourth terminal) of the integrated circuit IC3 from the smoothing capacitor C13. The light emitting element of the photo-coupler PC1 is connected between the power terminal (eighth terminal) and an output terminal (first terminal) of the integrated circuit IC3 via a resistor R63. When the lighting current detected by the current detecting resistor R4 becomes higher than a target current set by the dimming control circuit 80, the resistance value of the transistor Q4 decreases and current flowing to the light emitting element of the photo-coupler PC1 increases. Thus, the resistance value of the light receiving element of the photo-coupler PC1 decreases. Because the controller shortens the ON time width of the power switch Q1, the voltage of the smoothing capacitor C1 and the lighting current detected by the current detecting resistor R4 decreases.

When the lighting current detected by the current detecting resistor R4 becomes lower than the target set by the dimming control circuit 80, the resistance value of the transistor Q4 increases, the current flowing to the light emitting element of the photo-coupler PC1 decreases, and the resistance value of the light receiving element of the photo-coupler PC1 increases. Thus, because the ON time width of the power switch Q1 is extended, the voltage of the smoothing capacitor C1 rises and the lighting current detected by the current detecting resistor R4 increases. As a result, the lighting current detected by the current detecting resistor R4 is controlled to be a constant value corresponding to the target current set by the dimming control circuit 80.

Although not shown, as in the embodiment shown in FIG. 2, in the low luminance range, feedback control may be terminated by stopping power supply to the eighth terminal of the integrated circuit IC3 and short-circuiting the first terminal to a ground level.

The configuration and operation of the dimming control circuit 80 may now be described. The dimming control circuit 80 includes a photo-coupler PC3 for receiving a dimming control signal as a low frequency PWM signal, a Schmidt inverter IC2 for shaping a waveform of the received optical output, and peripheral circuitry.

The Schmidt inverter IC2 is, for example, TC7SH14F manufactured by Toshiba Corporation. When the input voltage is higher than an upper threshold value, the output voltage becomes a Low level, and when the input voltage is lower than a lower threshold value, the output voltage becomes a High level. The output voltage has a hysteresis characteristic of about 20 to 30% of the bias voltage Vcc between the upper threshold value and the lower threshold value, and even when a waveform of the input voltage is unchanged, the output voltage becomes a rectangular wave voltage.

The input terminal of the Schmidt inverter IC2 is connected to a line of the bias voltage Vcc via a pull-up resistor R85 and is also connected to ground via a series circuit formed of a resistor R84 and a transistor Q5. A capacitor C82 is connected in parallel to the series circuit formed of the resistor R84 and the transistor Q5. The capacitor C82 may be a small-capacitance noise removing capacitor having no significant smoothing function.

A second bias voltage obtained by dividing the bias voltage Vcc by a resistive voltage dividing circuit formed of resistors R82, R83 is supplied between the base and emitter of the transistor Q5. A capacitor C81 is connected in parallel to the resistor R83, and the light receiving element of the photo-coupler PC3 is connected in parallel to the resistor R83 via a resistor R81. The capacitor C81 is a small-capacity noise removing capacitor and having no significant smoothing function.

The dimming control signal is a low frequency PWM signal (for example, a rectangular wave voltage signal of 1 kHz, 10V). The dimming control signal is inputted to the light emitting element of the photo-coupler PC3 via a resistor (not shown). This type of dimming control signal is widely used in the field of inverter type driver circuits for fluorescent lamps.

When the dimming control signal is at a High level, the light receiving element of the photo-coupler PC3 is turned on as a function of the optical signal of the light emitting element of the photo-coupler PC3. The base of transistor Q5 is reverse biased, resulting in that the transistor Q5 is in a high resistance state. Thus, when the input voltage of the Schmidt inverter IC2 becomes higher than the upper threshold value, the output voltage of the Schmidt inverter IC2 becomes a Low level.

When the dimming control signal is at a Low level, the optical signal of the light emitting element of the photo-coupler PC3 is not emitted. As a result, the light receiving element of the photo-coupler PC3 is turned off, and a base bias is supplied to the transistor Q5 via the resistor R82 such that the transistor Q5 is in a low resistance state. Thus, when the input voltage of the Schmidt inverter IC2 becomes lower than the lower threshold value, the output voltage of the Schmidt inverter IC2 becomes a High level.

When the output voltage of the Schmidt inverter IC2 is at a High level, the capacitor C83 is charged via a diode D9 and a resistor R87 such that the voltage of the capacitor C83 rises. A discharging resistor R88 is connected to the capacitor C83 in parallel. When the output voltage of the Schmidt inverter IC2 is at a Low level, the voltage of the capacitor C83 decreases. The time constant for charging/discharging is set to be comparatively larger than a cycle of the dimming control signal, and the capacitor C83 has a substantial smoothing function. Thus, the voltage of the capacitor C83 corresponds to a length of time during which the output voltage of the Schmidt inverter IC2 is at a High level, and becomes higher as a period during which the dimming control signal inputted to the photo-coupler PC3 is at a Low level increases.

The light emitting element of the photo-coupler PC2 is connected to the output of the Schmidt inverter IC2 via a resistor R86. When the output voltage of the Schmidt inverter IC2 is at a High level, current flows to the light emitting element of the photo-coupler PC2 via the resistor R86. Because the light receiving element of the photo-coupler PC2 is turned on and the fourth terminal of the timer circuit TM2 is at a High level, the timer circuit TM2 begins operating. When the output voltage of the Schmidt inverter IC2 is at a Low level, no current flows to the light emitting element of the photo-coupler PC2, and the light receiving element of the photo-coupler PC2 is turned off. At this time, because the fourth terminal of the timer circuit TM2 is at a Low level, the timer circuit TM2 ceases operating.

Accordingly, when the output voltage of the Schmidt inverter IC2 is at a High level (i.e., the low frequency PWM signal received by the photo-coupler PC3 of the dimming control circuit 80 is at a Low level) the high frequency ON/OFF operation of the power switch Q1 is enabled. Conversely, when the output voltage of the Schmidt inverter IC2 is at a Low level (i.e., the low frequency PWM signal received by the photo-coupler PC3 of the dimming control circuit 80 is at a High level) the power switch Q1 is kept in its OFF state. In this manner, burst dimming control is performed according to the low frequency PWM signal received by the photo-coupler PC3.

In a burst ON state in which the high frequency ON/OFF operation of the power switch Q1 is allowed, the ON pulse width of the power switch Q1 is feedback controlled by the feedback controller 6. That is, the ON pulse width of the power switch Q1 is controlled so that a detected value of the smoothed DC current flowing from the smoothing capacitor C1 to the semiconductor light-emitting element 4, which is detected by the current detecting resistor R4, matches the voltage of the capacitor C83 of the dimming control circuit 80.

In FIG. 4, a capacitor C10 may be a small-capacity film capacitor for bypassing high-frequency ripple of the smoothing capacitor C1.

The capacitor C7 is an output capacitor of the step-up chopper circuit 1*c* as shown in FIG. 1, and the DC power source voltage Vdc is controlled to be constant. The bias voltage Vcc generated by the control power circuit 2 may be supplied to a PFC control circuit for controlling a step-up chopper circuit.

Figure 5:
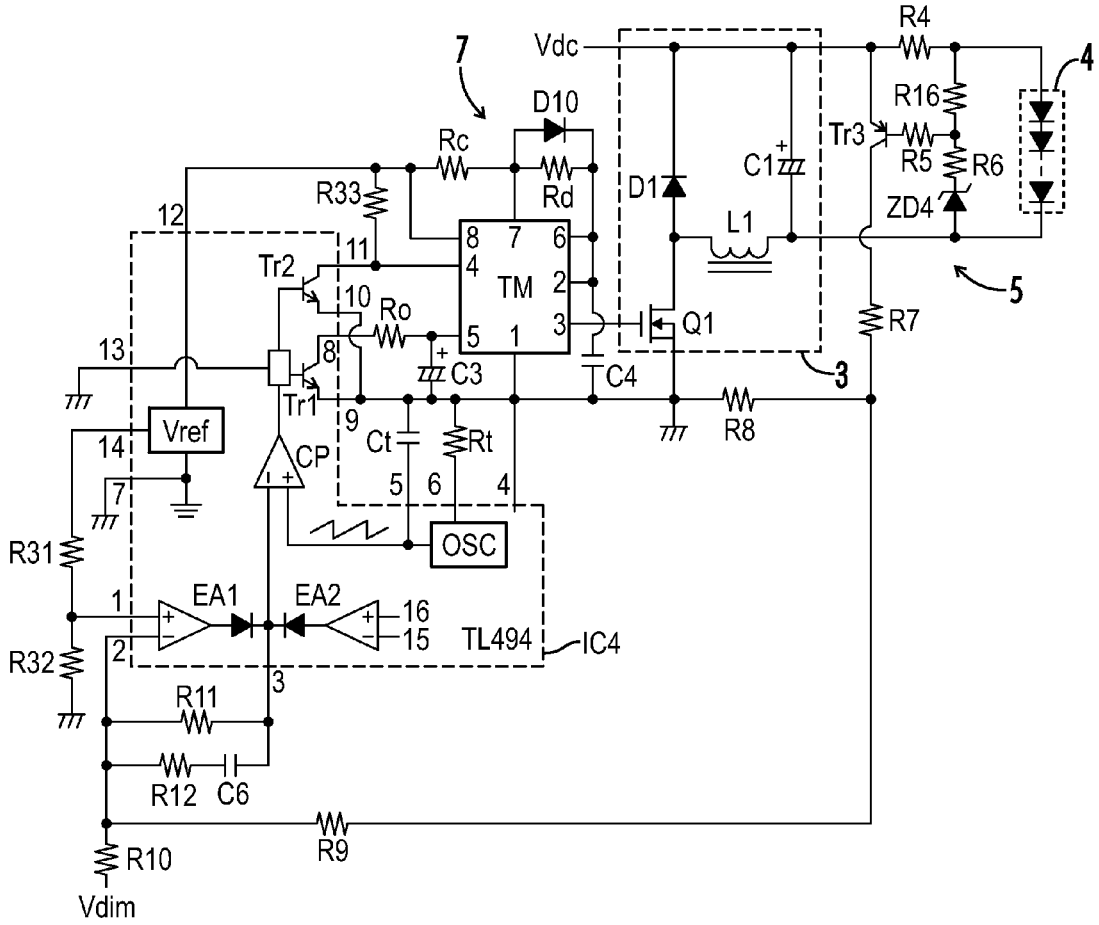
FIG. 5 is a circuit diagram of a fifth embodiment of the present invention.

FIG. 5 is a circuit diagram of another embodiment of the present invention. In the present embodiment, the high-frequency oscillating circuit 7 is configured of a single timer circuit TM. A PWM control circuit IC4 performs control to intermittently stop the high frequency oscillating operation at a low frequency and control of the high frequency ON time width and OFF time width. When allowing operation of the timer circuit TM, the PWM control circuit IC4 sets a fourth terminal of the timer circuit TM to a High level.

The general timer IC (e.g., a 555 timer) shown in FIG. 3A can be used as the timer circuit TM. The timer circuit TM operates as an astable multivibrator. When the voltage at the second terminal is lower than half of the voltage at the fifth terminal, an internal flip-flop is inverted, the third terminal becomes a High level, and the seventh terminal is opened, such that the capacitor C4 begins charging via a charging resistor Rc and a diode D10. When the voltage of the capacitor C4, which is applied to the sixth terminal, becomes higher than the voltage at the fifth terminal, the internal flip-flop is inverted and the third terminal (output terminal) is set to a Low level, such that the seventh terminal (discharging terminal) is short-circuited to the first terminal. As a result, the capacitor C4 discharges via a discharging resistor Rd, reducing the voltage of the capacitor C4. When the voltage of the capacitor C4, which is applied to the second terminal, is less than half of the voltage at the fifth terminal, the internal flip-flop is inverted, the third terminal is set to a High level, and the seventh terminal is opened, such that the capacitor C4 is charged via the charging resistor Rc and the diode D10. Thereafter, the same operations are repeated.

As described above, the timer circuit TM operates as a general astable multivibrator. The ON time width of the power switch Q1 is a variable width determined based on the time constants of the charging resistor Rc and the capacitor C4 and the voltage at the fifth terminal. The OFF time width of the power switch Q1 is a variable width determined according to the time constants of the discharging resistor Rd and the capacitor C4, and the voltage at the fifth terminal. Accordingly, the power switch Q1 is driven with the ON time width and the OFF time width that correspond to the voltage at the fifth terminal of the timer circuit TM. When the voltage at the fifth terminal decreases, a change in width of the voltage of the oscillating capacitor C4 becomes small, and thus, both the ON time width and the OFF time width decrease. However, because the charging current via the resistor Rc increases while the discharging current via the resistor Rd decreases, a reduction rate of the ON time width is larger than that of the OFF time width.

Figure 6A:
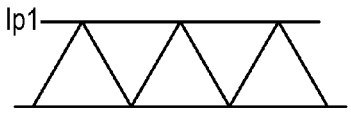
FIGS. 6A and 6B are graphical representations of operational waveforms of the fifth embodiment of the present invention.

This is advantageous for driving a light emitting diode having a substantially constant load voltage. By designing a ratio of the ON time width to the OFF time width such that when the voltage at the fifth terminal is maximum, as shown in FIG. 6A, current flows to the inductor L1 in a discontinuous mode close to a critical mode, even when the voltage at the fifth terminal varies, operation in the discontinuous mode can be assured at all times. Specifically, the values of the resistors Rc, Rd and the capacitor C4 may be selected so that the ON time width is slightly less than it would be under a critical condition (i.e., ON time width×(power voltage−load voltage) is almost equal to OFF time width×load voltage).

Figure 6B:
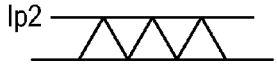

In such a configuration, when the voltage at the fifth terminal decreases, as shown in FIG. 6B, both the ON time width and the OFF time width of the power switch Q1 are reduced, but the reduction rate of the ON time width is larger than that of the OFF time width. Thus, the suspension period of the current flowing to the inductor L1 increases.

Accordingly, when the PWM control circuit IC4 reduces the voltage at the fifth terminal of the timer circuit TM, as shown in FIG. 6B, the peak current flowing to the inductor L1 is reduced and the suspension period of the current is increased. Thus, average current flowing to the inductor L1 in a burst ON period is decreased.

In combination with this control, by switching the fourth terminal of the timer circuit TM via the PWM control circuit IC4 to High/Low at low frequency (for example, 1 kHz) to make the burst ON period variable, it is possible to achieve stable dimming control in a wide range from a state where a high average current is passed for a long time to a state where a low average current is passed for a short time.

For example, a TL494 manufactured by Texas Instruments Incorporated or its equivalents can be used as the PWM control circuit IC4. This IC includes a sawtooth wave generator OSC, a comparator CP, error amplifiers EA1, EA2, output transistors Tr1, Tr2 and a reference voltage source therein. The IC oscillates at a fixed frequency determined by a capacitor Ct and a resistor Rt that are externally attached to the fifth terminal and the sixth terminal, respectively. The IC generates a PWM signal with a pulse width corresponding to the voltage at the third terminal. The oscillating frequency may be, for example, a low frequency such as 1 kHz. The fourth terminal is a dead time setting terminal and is connected to ground in the present embodiment.

The output of the error amplifier EA1 connected to the first and second terminals is diode OR connected with the output of the error amplifier EA2 connected to terminals 15 and 16 such that a higher output of the two error amplifiers becomes a reference voltage of the comparator CP. Here, as in embodiment shown in FIG. 4, the second error amplifier EA2 is not used.

Terminal 13 is a terminal for selecting between a single end operation and a push pull operation. In the present embodiment, the single end operation is selected by connection to ground. In this case, the transistors Tr1, Tr2 are operated together by internal logic circuits.

When the transistor Tr2 at terminals 11 and 10 is turned on, the fourth terminal of the timer circuit TM becomes a Low level, such that the high frequency oscillating operation of the high-frequency oscillating circuit 7 is stopped and the power switch Q1 is kept in its OFF state. When the transistor Tr2 is turned off, the fourth terminal of the timer circuit TM is pulled up to a potential of the bias voltage Vcc by a resistor R33, and the high frequency oscillating operation of the high-frequency oscillating circuit 7 is started.

When the transistor Tr1 at terminals 8 and 9 is turned on, the capacitor C3 is discharged via the resistor Ro. When the transistor Tr1 is turned off, the capacitor C3 is charged by the output of the voltage divider of a bleeder resistor included in the timer circuit TM. The transistor Tr1 is turned ON/OFF at a low frequency, and as a ratio of the ON time to OFF time in each cycle increases, the voltage of the capacitor C3 decreases. Thereby, the ON time width of the power switch Q1 is reduced.

Because the ratio of the ON time to the OFF time in one cycle of the transistors Tr1, Tr2 is feedback controlled according to a detection output of the output sensor 5, the ON time width of the power switch Q1 together with the burst ON time of the power switch Q1 is also feedback controlled.

The feedback controller includes the error amplifier EA1 and an external CR circuit. A feedback impedance including the resistors R11, R12 and the capacitor C6 is connected between an inverting input terminal and the output terminal of the error amplifier EA1. A constant voltage obtained by dividing a reference voltage Vref at the terminal 14 by the resistors R31, R32 is applied to a non-inverting input terminal of the error amplifier EA1. The voltage of the output terminal of the error amplifier EA1 varies such that the voltage of the inverting input terminal of the error amplifier EA1 matches the voltage of the non-inverting input terminal. The inverting input terminal of the error amplifier EA1 receives a detection voltage Vdet of the output sensor 5 via the first input resistor R9. The inverting input terminal of the error amplifier EA1 also receives the dimming control voltage Vdim via the second input resistor R10.

When the dimming control voltage Vdim increases, the output voltage of the error amplifier EA1 decreases, and the ON time of the transistors Tr1, Tr2 increases, increasing a period during which the ON/OFF operation of the power switch Q1 is stopped. Further, because a reference voltage at the fifth terminal of the timer circuit TM decreases, the ON time width of the power switch Q1 decreases. Conversely, when the dimming control voltage Vdim decreases, the output voltage of the error amplifier EA1 increases and the ON period of the transistors Tr1, Tr2 decreases, decreasing the period during which the ON/OFF operation of the power switch Q1 is stopped. Further, because the reference voltage at a fifth terminal of the timer circuit TM increases, the ON time width of the power switch Q1 increases.

Also in the case where the detection voltage Vdet varies when the dimming control voltage Vdim is constant, feedback control is performed so as to suppress variation in outputs according to the above-mentioned operations. That is, when the detection voltage Vdet increases, the period during which the ON/OFF operation of the power switch Q1 is stopped increases, and the high frequency ON time width of the power switch Q1 decreases. Conversely, when the detection voltage Vdet decreases, the period during which the ON/OFF operation of the power switch Q1 is stopped decreases, and the high frequency ON time width of the power switch Q1 increases. In this manner, feedback control is performed so as to suppress variation in outputs so that the detection voltage Vdet corresponds to the magnitude of the dimming control voltage Vdim.

The output sensor 5 may now be described. The semiconductor light-emitting element 4 is serially connected with the current detecting resistor R4. A bypass circuit is connected in parallel with the semiconductor light-emitting element 4. The bypass circuit is a series circuit formed of voltage dividing resistors R16, R6 and a zener diode ZD4. A constant of the bypass circuit is set such that the bypass current of the bypass circuit is larger than the lighting current flowing to the semiconductor light-emitting element 4 when the lighting current is close to the dimming control lower limit. Thereby, stable dimmed lighting can be achieved near the dimming control lower limit.

When the lighting current flowing to the semiconductor light-emitting element 4 increases or decreases, the voltage across the resistor R4 increases or decreases. When the applied voltage of the semiconductor light-emitting element 4 increases or decreases, the voltage across the resistor R16 increases or decreases. Accordingly, when the lighting current or the applied voltage of the semiconductor light-emitting element 4 increases or decreases, the voltage across the series circuit formed of the resistor R4, R16 increases or decreases.

Because the voltage obtained by subtracting the voltage between the base and emitter of the transistor Tr3 from the voltage across the series circuit formed of the resistor R4, R16 is applied to the resistor R5, base current corresponding to the voltage across the series circuit formed of the resistor R4, R16 flows to the transistor Tr3. Because collector current corresponding to the base current flows to the series circuit formed of the resistors R7, R8, the detection voltage Vdet reflects both the lighting current and the applied voltage of the semiconductor light-emitting element 4.

When the value of the resistor R4 is zero, the output sensor 5 functions as the voltage sensor 5*a* and when the value of the resistor R16 is zero, the output sensor 5 functions as the current sensor 5*b*. By properly setting the values of the resistors R4, R16, the output sensor 5 functions as a circuit for detecting and approximating load power.

A current corresponding to the sum of the lighting current flowing to the semiconductor light-emitting element 4 and the bypass current flowing to the bypass circuit flows through the resistor R4. Accordingly, even when the lighting current flowing to the semiconductor light-emitting element 4 is close to zero, the bypass current flowing to the bypass circuit flows through the resistor R4, preventing the transistor Tr3 from being blocked.

The zener voltage of the zener diode ZD4 is set to be less than the voltage that can light the semiconductor light-emitting element 4. Thus, whenever the semiconductor light-emitting element 4 is lighted, the voltage occurs at the resistor R16, thereby preventing the transistor Tr3 from being blocked.

As described above, in the output sensor 5 shown in FIG. 5, the bypass current flowing to the bypass circuit is used as a bias current for conduction of the diode between the base and the emitter of the output detecting transistor Tr3. Thus, even when the lighting current or the applied voltage of the semiconductor light-emitting element 4 is low, the output detecting transistor Tr3 is not blocked and is biased so as to operate in an active range at all times.

As described in the embodiment shown in FIG. 4, the lighting current and the applied voltage of the semiconductor light-emitting element 4 may be separately detected to perform feedback control according to the lighting current by the first error amplifier EA1. The lighting current and the applied voltage of the semiconductor light-emitting element 4 may also be separately detected to perform feedback control according to the applied voltage by the second error amplifier EA2. It is known that it may be preferred to perform the former control in the medium to high luminance range and to perform the latter control in the low luminance range (see JPA 2009-232623)

Figure 7A:
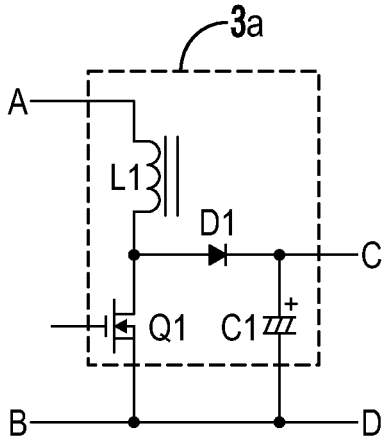
FIGS. 7A, 7B, and 7C are circuit diagrams each showing examples of a DC-DC converter for use in the present invention.
Figure 7B:
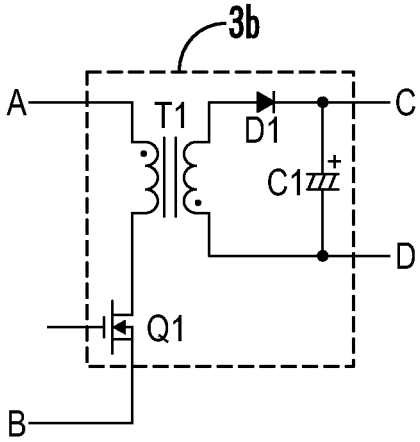
Figure 7C:
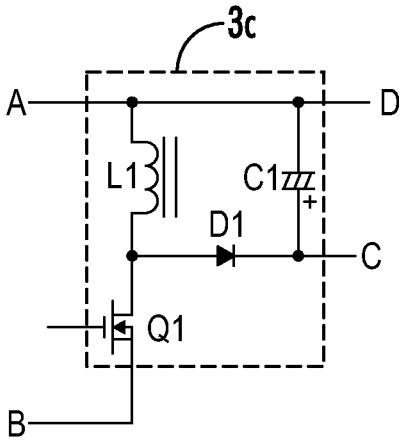

Although the step-down chopper circuit is used as the DC-DC converter 3 in each of the above-mentioned embodiments, various switching power circuits may be used as the DC-DC converter according to the present invention as shown in FIGS. 7A to 7C. FIG. 7A shows a step-up chopper circuit 3*a*, FIG. 7B shows a flyback converter circuit 3*b*, and FIG. 7C shows a step-up/down chopper circuit 3*c*.

In any case, it is assumed that the DC-DC converter includes at least a power switch Q1, an inductive element (the inductor L1 or a transformer T1) and a freewheeling diode D1. It is also assumed that the DC-DC converter operates in the discontinuous mode in which energy stored from the DC power source into the inductive element during the ON time of the power switch Q1, the stored energy is released from the inductive element via the freewheeling diode D1 during the OFF time of the power switch Q1, and the power switch Q1 is turned back on after a complete release of the energy from the inductive element.

Figure 8:
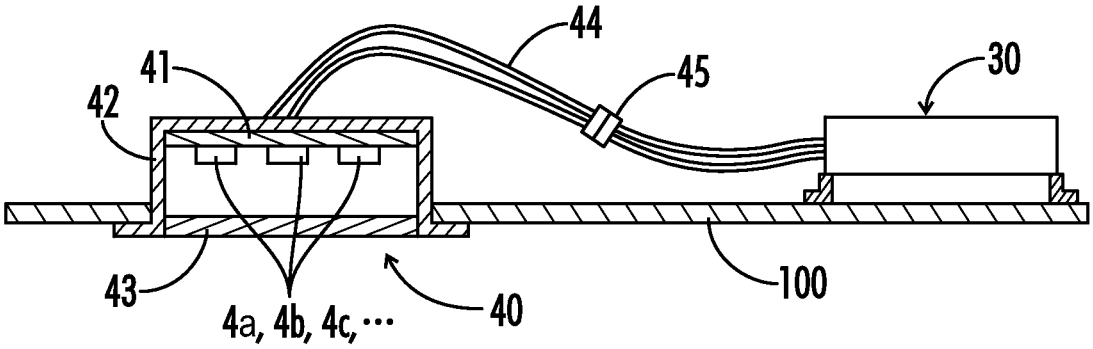
FIG. 8 is a sectional view showing a schematic configuration of a light fixture according to an embodiment of the present invention.

FIG. 8 shows a schematic configuration of a power source-separated type LED light fixture using the LED driver circuit according to the present invention. The power source-separated type LED light fixture includes a driver circuit 30 as a power source unit in a case other than a housing 42 of an LED module 40. This can make the LED module 40 thinner and the driver circuit 30 as the separated-type power source unit can be installed at any place.

The fixture housing 42 is formed of a metallic cylindrical body having an open lower end. The open lower end is covered with a light diffusing plate 43. The LED module 40 is arranged as opposed to the light diffusing plate 43. An LED mounting board 41 mounts LEDs 4*a*, 4*b*, 4*c*, etc. of the LED module 40 thereon. The fixture housing 42 is embedded in a ceiling 100 and is wired to the driver circuit 30 as the power source unit arranged in the ceiling cavity via a lead 44 and a connector 45.

The circuits described in each of the above-mentioned embodiments are stored in the driver circuit 30 as the power source unit. The series circuit formed of the LEDs 4*a*, 4*b*, 4*c*, etc., (LED module 40) corresponds to the semiconductor light-emitting element 4.

In the present embodiment, the power source-separated type LED light fixture is exemplified, in which the driver circuit 30 as the power source unit is stored in the housing other than the housing of the LED module 40. However, the driver circuit according to the present invention may be applied to a power source-integrated type LED light fixture in which the power source unit and the LED module 40 are stored in the same housing.

The driver circuit according to the present invention is not limited to a light fixture and may be used as, for example, a backlight of a liquid crystal display or a light source for a copier, a scanner, a projector, and the like.

Although a light emitting diode is used as the semiconductor light-emitting element 4 in each of the above-mentioned embodiments, the semiconductor light-emitting element 4 is not limited to this, and may be, for example, an organic EL element and a semiconductor laser element. Although to MOSFET is exemplified as the power switch Q1, other switching elements such as an IGBT may be used.

Thus, although there have been described particular embodiments of the present invention of a new and useful Semiconductor Light-Emitting Element Driver circuit and Light fixture Using the Same it is not intended that such references be construed as limitations upon the scope of this invention except as set forth in the following claims.

What is claimed is:

1. A driver circuit operable to provide a current to a semiconductor light-emitting element, said driver circuit comprising:

a DC-DC converter operable to provide current to the semiconductor light-emitting element from a DC power source, said DC-DC converter comprising an inductor, a freewheeling diode, and a power switch, wherein the power switch is configured to receive a pulse width modulated signal and cycle ON and OFF as a function of the pulse width modulated signal;

a high frequency oscillating circuit operable to provide the pulse width modulated signal to the power switch of the DC-DC converter as a function of a reference voltage and a low frequency PWM signal and cycle the pulse width modulated signal between an ON state and an OFF state, wherein the high frequency oscillating circuit is further operable to maintain the pulse width modulated signal in the OFF state when the low frequency PWM signal is in an OFF state;

an output sensor operable to provide a detection output indicative of at least one of the voltage of the semiconductor light-emitting element, the current provided by the DC-DC converter, or a power provided by the DC-DC converter;

a dimming control circuit operable configured to receive a dimming control signal and provide a target value and the low frequency PWM signal as a function of the received dimming control signal; and a feedback controller operable to receive the detection output from the output sensor and the target value from the dimming control circuit and provide the reference voltage to the high frequency oscillating circuit as a function of the received detection output and the target value, wherein the feedback controller is operable to provide a minimum reference voltage when the received target value corresponds to a reference voltage less than the minimum reference voltage.

2. The driver circuit of claim 1, wherein the dimming control circuit is further operable to maintain the low frequency PWM signal in an ON state when the target value corresponds to a reference voltage above the minimum reference voltage.

3. The driver circuit of claim 1, wherein the dimming control circuit is further operable to cycle low frequency PWM signal between an ON state and an OFF state when the target value corresponds to a reference voltage at or below the minimum reference voltage.

4. The driver circuit of claim 1, wherein the DC-DC converter is configured to operate only in a discontinuous mode by the high frequency oscillating circuit.

5. The driver circuit of claim 1, wherein a current of the feedback controller is blocked when the target value corresponds to a reference voltage at or below the minimum reference voltage.

6. The driver circuit of claim 1, further comprising a bypass circuit operable to draw a bypass current from the DC-DC converter larger than a current through the semiconductor light-emitting element when the dimming control voltage corresponds to a reference voltage at or below the minimum reference voltage.

7. The driver circuit of claim 1, further comprising a bypass circuit operable to draw a bypass current from the DC-DC converter larger than a current through the semiconductor light-emitting element when the dimming control signal corresponds to a reference voltage at or below the minimum reference voltage;

wherein the current through the semiconductor light-emitting element is larger than the bypass current when the dimming control signal corresponds to a reference voltage greater than the minimum reference voltage.

8. The driver circuit of claim 1, further comprising:

the DC power source is operable to provide a DC voltage from an alternating current power source;

a DC regulator operable to provide a bias voltage and to regulate the DC voltage provided by the DC power source; and wherein the dimming control circuit comprises a dimming signal circuit operable to receive a the dimming control signal and provide a dimming control voltage, wherein the dimming control signal is pulse width modulated, and wherein the dimming signal circuit comprises a non-polarizing circuit, an isolating circuit, and a DC converting circuit.

9. A driver circuit for a semiconductor light-emitting element comprising:

a DC-DC converter operable to supply a current to the semiconductor light-emitting element from a DC power source;

a dimming controller operable to control the DC-DC converter to adjust a magnitude of the current supplied to the semiconductor light-emitting element as a function of a dimming control signal;

the DC-DC converter comprises a switching element, an inductive element, and a regenerative diode;

the DC-DC converter operates in a discontinuous mode in which energy from the DC power source is stored in the inductive element during an ON time of the switching element and released from the inductive element through the regenerative diode during a subsequent OFF time of the switching element;

the switching element is turned on after a complete release of energy stored in the inductive element; and the dimming controller comprises:

a burst dimming controller operable to intermittently stop an ON/OFF operation of the switching element, thereby reducing the current supplied to the semiconductor light-emitting element by the DC-DC converter, an output sensor operable to detect at least one of the current supplied to the semiconductor light-emitting element or the voltage of the semiconductor light-emitting element, and a feedback circuit operable to adjust the ON time ratio of the switching element during the ON/OFF operation such that a detected value of the output sensor approaches a target value.

10. The driver circuit of claim 9, wherein the burst dimming controller is operable to intermittently stop the ON/OFF operation of the switching element throughout a range of the dimming control signal.

11. The driver circuit of claim 9, wherein the burst dimming controller is operable to intermittently stop the ON/OFF operation of the switching element when the dimming control signal is less than a predetermined value.

12. The driver circuit of claim 9, wherein the dimming controller blocks power to the feedback circuit when the dimming control signal is less than a predetermined value.

13. A light fixture comprising:

the driver circuit according to claim 9;

a housing supporting the driver circuit; and the semiconductor light-emitting element operable to receive the current supplied by the driver circuit.

14. A driver circuit for a semiconductor light-emitting element comprising:

a DC-DC converter operable to supply a current to a semiconductor light-emitting element from a DC power source; and a dimming controller operable to control the DC-DC converter to adjust a magnitude of the current supplied to the semiconductor light-emitting element as a function of a dimming control signal, wherein the DC-DC converter comprises a switching element, an inductive element, and a regenerative diode, the DC-DC converter operates in a discontinuous mode in which energy from the DC power source is stored in the inductive element during an ON time of the switching element and released from the inductive element through the regenerative diode during an OFF time of the switching element, the switching element is turned on after a complete release of energy stored in the inductive element; and the dimming controller comprises:

a burst dimming controller operable to intermittently stop an ON/OFF operation of the switching element, thereby reducing the current supplied to the semiconductor light-emitting element by the DC-DC converter;

an output sensor operable to detect at least one of the current supplied to the semiconductor light-emitting element or the voltage of to the semiconductor light-emitting element; and a feedback circuit operable to adjust a time during which the ON/OFF operation of the switching element is intermittently stopped such that a detected value of the output sensor approaches a target value.

15. The driver circuit of claim 14, wherein the burst dimming controller varies the ON time of an ON/OFF cycle of the switching element as a function of a DC voltage obtained by smoothing a signal from the burst dimming controller intermittently stopping the ON/OFF operation of the switching element.

16. The driver circuit claim 14, further comprising a bypass circuit connected in parallel with the semiconductor light-emitting element, wherein the bypass circuit is operable to draw a bypass current from the DC-DC converter larger than the current supplied to the semiconductor light-emitting element when the current supplied to the semiconductor light-emitting element is at or below a dimming control lower limit, and wherein the output sensor is operable to detect the sum of a current through the semiconductor light-emitting element and the bypass current as the current supplied to the semiconductor light-emitting element by the DC-DC converter.

17. A light fixture comprising:

the driver circuit according to claim 14;

a housing supporting the driver circuit; and the semiconductor light-emitting element operable to receive the current supplied by the driver circuit.

18. A light fixture comprising:

a housing;

a semiconductor light-emitting element supported by the housing and operable to receive a current and provide luminance as a function of the received current;

a driver circuit supported by the housing and operable to provide the current to the semiconductor light-emitting element comprising:

a DC-DC converter operable to provide a current to the semiconductor light-emitting element from a DC power source, said DC-DC converter comprising an inductor, a freewheeling diode, and a power switch, wherein the power switch is operable to receive a pulse width modulated signal and cycle ON and OFF as a function of the pulse width modulated signal; and a high frequency oscillating circuit operable to provide the pulse width modulated signal to the power switch of the DC-DC converter as a function of a reference voltage and a low frequency PWM signal and cycle the pulse width modulated signal between an ON state and an OFF state, wherein the high frequency oscillating circuit is further operable to maintain the pulse width modulated signal in the OFF state when the low frequency PWM signal is in an OFF state;

an output sensor operable to provide a detection output indicative of at least one of the voltage of the semiconductor light-emitting element, the current provided by the DC-DC converter, or a power provided by the DC-DC converter;

a dimming control circuit operable to receive a dimming control signal and provide a target value and the low frequency PWM signal as a function of the received dimming control signal;

a feedback controller operable to receive the detection output from the output sensor and the target value from the dimming control circuit and provide the reference voltage to the high frequency oscillating circuit as a function of the received detection output and the target value, wherein the feedback controller is operable to provide a minimum reference voltage when the received target value corresponds to a reference voltage less than the minimum reference voltage.

* * * * *